US011746639B2

(12) United States Patent
Day et al.

(10) Patent No.: US 11,746,639 B2
(45) **Date of Patent: *Sep. 5, 2023**

(54) TRONA SOLUTION MINING METHODS AND COMPOSITIONS

(71) Applicant: Sesqui Mining, LLC., Fort Collins, CO (US)

(72) Inventors: Roger L. Day, Rifle, CO (US); James A. Herickhoff, Fort Collins, CO (US)

(73) Assignee: SESQUI MINING, LLC., Fort Collins, CO (US)

( * ) Notice: Subject to any disclaimer, the term of this patent is extended or adjusted under 35 U.S.C. 154(b) by 123 days.

This patent is subject to a terminal disclaimer.

(21) Appl. No.: 17/399,806

(22) Filed: Aug. 11, 2021

(65) Prior Publication Data

US 2021/0372257 A1 Dec. 2, 2021

Related U.S. Application Data

(63) Continuation of application No. 16/453,400, filed on Jun. 26, 2019, now Pat. No. 11,193,362, which is a continuation of application No. 16/248,180, filed on Jan. 15, 2019, now Pat. No. 10,422,210.

(60) Provisional application No. 62/667,240, filed on May 4, 2018.

(51) Int. Cl.

| | |
|---|---|
| ***E21B 43/00*** | (2006.01) |
| ***E21B 43/28*** | (2006.01) |
| ***E21B 43/34*** | (2006.01) |
| ***C22B 3/20*** | (2006.01) |
| ***C22B 26/10*** | (2006.01) |

(52) U.S. Cl.

CPC ..... *E21B 43/28* (2013.01); *C22B 3/20* (2013.01); *C22B 26/10* (2013.01); *E21B 43/34* (2013.01)

(58) Field of Classification Search

CPC ..... E21B 43/28; E21B 43/29; E21B 43/34
USPC ..... 423/206.2, 208
See application file for complete search history.

(56) References Cited

U.S. PATENT DOCUMENTS

| | | | |
|---|---|---|---|
| 1,816,260 | A | 7/1931 | Lee |
| 2,388,009 | A | 10/1945 | Pike |
| 2,625,384 | A | 1/1953 | Pike et al. |
| 2,798,790 | A | 7/1957 | Pike et al. |
| 2,847,202 | A | 8/1958 | Pullen |
| 2,919,909 | A | 1/1960 | Rule |
| 2,979,317 | A | 4/1961 | Bays |
| 3,050,290 | A | 8/1962 | Caldwell et al. |
| 3,058,730 | A | 10/1962 | Bays |
| 3,083,760 | A | 4/1963 | Wills |
| 3,119,655 | A | 1/1964 | Frint et al. |
| 3,184,287 | A | 5/1965 | Gancy |
| 3,254,921 | A | 6/1966 | Halsey |
| 3,264,057 | A | 8/1966 | Miller |
| 3,273,958 | A | 9/1966 | Peverley |
| 3,273,959 | A | 9/1966 | Miller |
| 3,328,130 | A | 6/1967 | Gancy |
| 3,510,167 | A | 5/1970 | Carmody |
| 3,739,851 | A | 6/1973 | Beard |
| 3,759,574 | A | 9/1973 | Beard |
| 3,779,602 | A | 12/1973 | Beard et al. |
| 3,792,902 | A | 2/1974 | Towell et al. |
| 3,941,422 | A | 3/1976 | Henderson |
| 3,953,073 | A | 4/1976 | Kube |
| 3,983,939 | A | 10/1976 | Brown et al. |
| 4,222,611 | A | 9/1980 | Larson |
| 4,232,902 | A | 11/1980 | Cuevas |
| 4,285,915 | A | 8/1981 | Saldick et al. |
| 4,288,419 | A | 9/1981 | Copenhafer |
| 4,344,650 | A | 8/1982 | Pinsky et al. |
| 4,384,614 | A | 5/1983 | Justheim |
| 4,401,635 | A | 8/1983 | Frint |
| 4,411,474 | A | 10/1983 | Higgins |
| 4,418,960 | A | 12/1983 | Higgins |
| 4,425,003 | A | 1/1984 | Huff |
| 4,496,191 | A | 1/1985 | Choi |
| 4,498,706 | A | 2/1985 | Ilardi et al. |
| 4,584,077 | A | 4/1986 | Chlanda |
| 4,652,054 | A | 3/1987 | Copenhafer |
| 4,753,485 | A | 6/1988 | Goodhart |
| 4,785,882 | A | 11/1988 | Sprunt |
| 4,815,790 | A | 3/1989 | Rosar et al. |

(Continued)

OTHER PUBLICATIONS

"Directional Drilling," Schlumberger website, as early as Jul. 14, 2022, available at www.glossary.oilfield.slb.com/Display.cfm?Term=directional%20drilling, printed on Jun. 16, 2004, 1 page.

"Mining Methods," Pangea.Stanford.edu Website, as early as Feb. 24, 2001, available at pangea.stanford.edu/~kurt/tour/kurt-mining-methods.html, printed on Jun. 23, 2004, pp. 1-3.

Day, R., "Solution Mining of Colorado Nahcolite," Wyoming State Geological Survey Information Circular 40, 1998, pp. 121-130.

Day, R., "White River Nahcolite Solution Mine," Technical Paper, Society for Mining, Metallurgy, and Exploration, Preprint No. 94-210, Feb. 1994, pp. 1-4.

Dunn et al., "FMC's New Soda Ash Technology is a Success," Mining Engineering, Apr. 1999, pp. 25-28.

(Continued)

*Primary Examiner* — Steven J Bos
(74) *Attorney, Agent, or Firm* — Sheridan Ross P.C.

(57) ABSTRACT

The invention discloses a method of solution mining trona by injecting an aqueous solvent into an underground cavity comprising trona to dissolve trona in the aqueous solution and removing the aqueous solution from the cavity at about the WTN triple point (the temperature at which solid phase wegscheiderite, trona, and nahcolite can co-exist in an aqueous solution). Alkaline values from the removed aqueous solution are recovered to produce a barren liquor. The method further includes either (i) treating the barren liquor to produce an aqueous solvent or (ii) treating injected aqueous solvent to reduce clogging at the trona dissolution surface caused by supersaturation of sodium bicarbonate, and precipitation of nahcolite and wegscheiderite as the aqueous solution in the cavity approaches saturation of both dissolved sodium bicarbonate and sodium carbonate.

30 Claims, 3 Drawing Sheets

(56) References Cited

U.S. PATENT DOCUMENTS

| | | | |
|---|---|---|---|
| H000614 | H | 4/1989 | Norman, Sr. |
| 5,043,149 | A | 8/1991 | Frint et al. |
| 5,192,164 | A | 3/1993 | Frint et al. |
| 5,238,664 | A | 8/1993 | Frint et al. |
| 5,246,273 | A | 9/1993 | Rosar |
| 5,262,134 | A | 11/1993 | Frint et al. |
| 5,283,054 | A | 2/1994 | Copenhafer et al. |
| 5,431,482 | A | 7/1995 | Russo |
| 5,609,838 | A | 3/1997 | Neuman et al. |
| 5,618,504 | A | 4/1997 | Delling |
| 5,690,390 | A | 11/1997 | Bithell |
| 5,766,270 | A | 6/1998 | Neuman et al. |
| 5,955,043 | A | 10/1999 | Neuman et al. |
| 6,047,774 | A | 4/2000 | Allen |
| 6,228,335 | B1 | 5/2001 | Copenhafer et al. |
| 6,251,346 | B1 | 6/2001 | Neuman et al. |
| 6,322,767 | B1 | 11/2001 | Neuman et al. |
| 6,428,759 | B1 | 8/2002 | Smith et al. |
| 6,576,206 | B2 | 6/2003 | Copenhafer |
| 6,576,209 | B2 | 6/2003 | Tanaka et al. |
| 6,589,497 | B2 | 7/2003 | Smith |
| 6,609,761 | B1 | 8/2003 | Ramey et al. |
| 6,660,049 | B1 | 12/2003 | Day |
| 6,699,447 | B1 | 3/2004 | Nielsen et al. |
| 6,854,809 | B1 | 2/2005 | Ramey et al. |
| 7,611,208 | B2 | 11/2009 | Day et al. |
| 8,057,765 | B2 | 11/2011 | Day et al. |
| 8,899,691 | B2 | 12/2014 | Day et al. |
| 9,260,918 | B2 | 2/2016 | Day et al. |
| 10,422,210 | B1 | 9/2019 | Day et al. |
| 10,995,598 | B2 | 5/2021 | Day et al. |
| 2001/0001037 | A1 | 5/2001 | Kunio et al. |
| 2002/0009409 | A1 | 1/2002 | Copenhafer et al. |
| 2002/0054842 | A1 | 5/2002 | Copenhafer et al. |
| 2002/0192140 | A1 | 12/2002 | Smith |
| 2003/0029617 | A1 | 2/2003 | Brown et al. |
| 2004/0026982 | A1 | 2/2004 | Ramey et al. |
| 2004/0108110 | A1 | 6/2004 | Zupanick |
| 2004/0231109 | A1 | 12/2004 | Nielsen et al. |
| 2005/0231022 | A1 | 10/2005 | Brown et al. |
| 2020/0224521 | A1 | 7/2020 | Day et al. |

OTHER PUBLICATIONS

Fairchild et al., "A New Technology for the Soda Ash Deposits near Trona, California," Wyoming State Geological Survey Information Circular 40, 1998, pp. 143-152.

Frint, "FMC's Newest Goal: Commercial Solution Mining of Trona," Engineering and Mining Journal, Sep. 1985, pp. 26-35.

Garrett, D., "Solution Mining," Natural Soda Ash, Von Nostrand Reinhold, New York, NY, 1992, pp. 336-358.

Haynes, Jr. et al., "A Model for Solution Mining Trona," Wyoming State Geological Survey Information Circular 40, 1998, pp. 153-162.

Rosar, "Feasibility of Trona Solution Mining," Wyoming State Geological Survey Information Circular 40, 1998, pp. 131-142.

U.S. Appl. No. 11/206,659, filed Aug. 17, 2005, now issued as U.S. Pat. No. 7,611,208.

U.S. Appl. No. 12/566,446, filed Sep. 24, 2009, now issued U.S. Pat. No. 8,057,765.

U.S. Appl. No. 13/193,995, filed Jul. 29, 2011, now issued as U.S. Pat. No. 8,899,691.

U.S. Appl. No. 14/526,044, filed Oct. 28, 2014, now issued as U.S. Pat. No. 9,260,918.

U.S. Appl. No. 16/248,180, filed Jan. 15, 2019, now issued as U.S. Pat. No. 10/422,210.

U.S. Appl. No. 16/926,307, filed Jul. 10, 2020, now issued as U.S. Pat. No. 10/995,598.

U.S. Appl. No. 16/453,400, filed Jun. 26, 2019, published as U.S. Pub. No. 2020/0224521.

TRONA SOLUTION MINING METHODS AND COMPOSITIONS

CROSS REFERENCE TO RELATED APPLICATIONS

This application is a continuation of U.S. patent application Ser. No. 16/453,400, filed Jun. 26, 2019; which is a continuation of U.S. patent application Ser. No. 16/248,180, filed Jan. 15, 2019, now U.S. Pat. No. 10,422,210; which claims the benefit of U.S. Provisional Application No. 62/667,240, filed May 4, 2018; each of which is incorporated herein by reference.

FIELD OF THE INVENTION

The present invention relates to improved trona solution mining methods.

BACKGROUND OF THE INVENTION

Trona is a naturally occurring sodium sesquicarbonate ($Na_2CO_3 \cdot NaHCO_3 \cdot 2H_2O$). The Green River basin in southwestern Wyoming contains the world's largest known deposit of trona. Reserves in Wyoming amount to approximately 140 billion tons. In the Green River Basin there are approximately twenty-five beds of trona more than four feet thick with intervening strata of shale. These beds are encountered at a below surface depth between 500 and 3000 feet.

Globally, soda ash (i.e., sodium carbonate, $Na_2CO_3$ or SC) is a 54 million metric tons per year commodity. Synthetic soda ash manufactured from limestone and salt accounts for 73% of the global production. The remaining 27% is generally referred to a natural soda ash as it is produced from naturally occurring deposits of trona.

Trona is the principle source mineral for the United States soda ash industry and is generally produced by conventional underground mining methods, including solution mining. Non-solution mined ore is hoisted to the surface and is commonly processed into soda ash either by the "sesquicarbonate process" or the "monohydrate process." In the sesquicarbonate process, the processing sequence involves underground mining; crushing; dissolving raw ore in mother liquor; clarifying; filtering; recrystallizing sodium sesquicarbonate by evaporative cooling; and converting to a medium density soda ash product by calcining. The monohydrate process involves underground mining, crushing; calcining of raw trona ore to remove carbon dioxide and some organics to yield crude soda ash; dissolving the crude soda ash; clarifying the resultant brine; filtering the hot solution; removing additional organics; evaporating the solution to crystallize sodium carbonate monohydrate; and drying and dehydrating sodium carbonate monohydrate to yield the anhydrous soda ash product.

Solution mining of trona, such as taught by Day (U.S. Pat. No. 7,611,208) minimizes the environmental impact and reduces or eliminates the cost of underground mining, hoisting, crushing, calcining, dissolving, clarification, solid/liquid/vapor waste handling and environmental compliance.

Trona and nahcolite are the principle source minerals for the United States sodium bicarbonate ("SBC") industry. Sodium bicarbonate is produced by nahcolite solution mining or water dissolution and carbonation of mechanically or solution-mined trona ore or the soda ash produced from that ore. As taught by Day (U.S. Pat. Nos. 4,815,790 and 6,660,049), sodium bicarbonate is also produced by solution mining nahcolite, the naturally occurring form of sodium bicarbonate. Nahcolite solution mining utilizes directionally drilled boreholes and a hot aqueous solution comprised of dissolved soda ash, sodium bicarbonate and salt. In either case, the sodium bicarbonate is produced by cooling or a combination of cooling, and carbonation crystallization.

Kube in U.S. Pat. No. 3,953,073 teaches solution mining trona using sodium hydroxide to prevent "severe solubility suppression resulting, at least in part, from clogging of the dissolving face by sodium bicarbonate." Kube provides a 30° C. example (column 5, lines 14-39) of the benefit of using sodium hydroxide to prevent the solvent from contacting a "virtually impenetrable barrier of sodium bicarbonate." The solution in contact with the SBC barrier is saturated at 6.7% SBC and 8.4% SC (12.6% total alkalinity reported as SC (TA)) whereas a saturated solution in contact with the non-encapsulated trona is saturated at 4.6% SBC and 17.3% SC (20.2% TA). SBC encapsulation can reduce trona solution mining productivity by about 40% (20.2% to 12.6%). Kube estimates the quantity of the SBC encapsulating the trona is 12.4 grams per 100 grams of water. Kube teaches the use of sufficient sodium hydroxide to convert 12.4 grams of SBC to SC to eliminate the encapsulating SBC and the solubility suppression. There are no commercial applications of Kube's invention. Commercial trona solution mining operations simply accept the solubility suppression described by Kube.

Therefore, there remains a need in the art for improved methods of solution mining for trona, to allow for recovery of a solution that is rich in desired dissolved minerals and lean in undesired dissolved minerals leading to more cost-effective commercial products from the solution, improved resource recovery, and reduced environmental impacts compared to conventional underground mining.

A problem with the use of the current aqueous trona solution mining methods is clogging of the trona dissolution surface caused by dissolved SBC supersaturation, and nahcolite and/or wegscheiderite precipitation, as the solution approaches double saturation. Double saturation refers to the condition where both dissolved SBC and SC are at saturation. The supersaturation and precipitation occur because, as trona dissolves in water or in the mixtures of SC, SBC, and water of the current solution mining practices, the solution becomes supersaturated in respect to dissolved SBC as the solution approaches double saturation. This is commonly referred to as incongruent dissolution. Supersaturated dissolved SBC can precipitate as either nahcolite or wegscheiderite on the face of the trona, clogging the trona dissolution surface and practically stopping the dissolution of trona. This hinders the resource recovery, the solution mining process, and the economics. Thus, there is a need for economical methods to eliminate or manage the consequences of the clogging.

SUMMARY OF THE INVENTION

Figure 1:
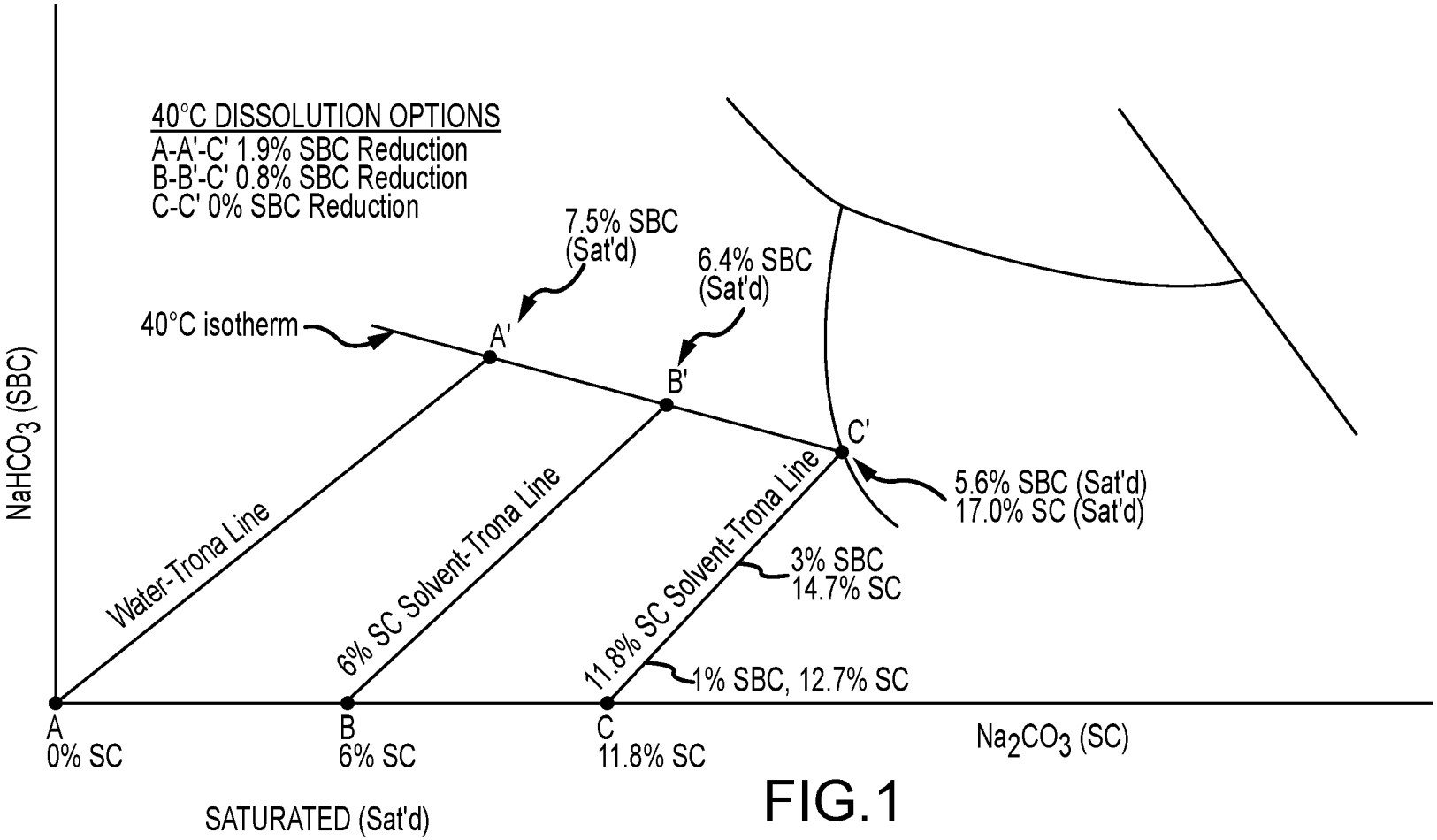
FIG. 1 is a simplified solubility diagram for the $Na_2CO_3$—$NaHCO_3$ system depicting a few examples of 40° C. trona solution mining alternatives typical of operations today at temperatures lower than the present invention.

The objective of this invention is an economic method to control or manage the debilitating trona solution mining consequences of clogging due to incongruent aqueous trona dissolution.

The present invention describes such a method of solution mining trona. The method includes injecting an aqueous solvent into an underground cavity comprising trona to dissolve trona in the cavity aqueous solution at a trona dissolution surface. The aqueous solution is removed from the cavity and when the aqueous solution is removed, it is at about the wegscheiderite, trona, and nahcolite ("WTN") triple point, that is, the temperature at which solid phase wegscheiderite, trona, and nahcolite can co-exist in an aqueous solution. Alkaline values from the removed aqueous solution are recovered resulting in a barren liquor. The method further includes producing an aqueous solvent that manages clogging by either (i) controlling the process of recovering the alkaline values or (ii) treating the barren liquor. Clogging is managed by controlling the supersaturation of sodium bicarbonate, and precipitation of nahcolite and wegscheiderite, as the aqueous solution in the cavity approaches double saturation of sodium bicarbonate and sodium carbonate. The step of recovering alkaline values from the removed aqueous solution includes (i) conversion of dissolved sodium carbonate to dissolved sodium bicarbonate; (ii) conversion of dissolved sodium bicarbonate to dissolved sodium carbonate; and (iii) crystallization and production of sodium carbonate, sodium bicarbonate, and/or sodium sesquicarbonate. Heat recovered from the step of recovering alkaline values is used to increase the temperature of the barren liquor and aqueous solvent in order to achieve low cost operation at the WTN triple point temperature.

In some embodiments, the step of treating the barren liquor to prepare the aqueous solvent can include the addition of sodium hydroxide. In this embodiment, the step of treating reduces the sodium bicarbonate supersaturation, and clogging during trona dissolution. In this embodiment, the reduction of sodium bicarbonate saturation approaching double saturation can be eliminated or controlled to less than about 0.8%, less than about 1%, less than about 1.5%, less than about 2%, less than about 3%. In this embodiment, the amount of sodium hydroxide added can be less than about 1%. In this embodiment, the volume of sodium hydroxide is related to the amount and ratio of the sodium carbonate and sodium bicarbonate that is unrecovered by the process of recovering the alkaline values from the removed aqueous solution.

In some embodiments of the invention, the step of treating the barren liquor includes adding sodium carbonate to the barren liquor to provide an aqueous solvent that manages sodium bicarbonate supersaturation and clogging as the aqueous solution in the cavity approaches double saturation. In this embodiment, the step of managing can include eliminating dissolved sodium bicarbonate supersaturation and clogging as the solution approaches double saturation by controlling the amount and ratio of dissolved sodium carbonate to dissolved sodium bicarbonate to conform to the equation sodium carbonate=((sodium bicarbonate×1.12)+4.8). In this embodiment, the step of managing can include a reduction of dissolved sodium bicarbonate approaching double saturation to less than about 0.8%, less than about 1%, less than about 1.5%, or less than about 2%. In this embodiment, the step of treating can further include converting dissolved sodium bicarbonate to dissolved sodium carbonate, and the step of converting can include adding sodium hydroxide to the barren liquor to convert dissolved sodium bicarbonate to dissolved sodium carbonate, such addition of sodium hydroxide can be at a concentration of less than 1%. In this embodiment, the step of adding sodium carbonate and/or sodium hydroxide (a choice based on cost effectiveness) is directly related to the amount and ratio of the dissolved sodium carbonate and sodium bicarbonate, unrecovered from the aqueous solution and recycled to the mine in the barren liquor, by the process of recovering the alkaline values from the removed aqueous solution. That is, the amount of sodium carbonate and/or sodium hydroxide added is proportionately related (e.g., stoichiometrically related) based on an intended reaction between the added sodium carbonate and/or sodium hydroxide and chemical species in the barren liquor.

In one embodiment, the step of sodium hydroxide and/or sodium carbonate treatment can eliminate the saturation reduction in dissolved sodium bicarbonate as the solution approaches double saturation or can control the sodium bicarbonate saturation approaching double saturation to less than about 0.8%, less than about 1%, less than about 1.5%, less than about 2%, or less than 3%. In this embodiment, the step of adding sodium hydroxide and sodium carbonate treatment can be directly related to the amount and ratio of the sodium carbonate and sodium bicarbonate unrecovered from the aqueous solution, and recycled to the mine in the barren liquor, by the process of recovering the alkaline values from the removed aqueous solution. In this embodiment, the sodium hydroxide can be added at a concentration of less than 1% or the step of adding sodium hydroxide can reduce the amount of sodium carbonate required to achieve an amount and ratio of the of dissolved sodium carbonate to sodium bicarbonate in the injected aqueous solvent of about the formula: sodium carbonate=((sodium bicarbonate×1.12)+4.8).

In other embodiments of the invention, the removed aqueous solution can be at a temperature of about 70° C. to about 110° C., a temperature of about 77° C. to about 97° C., a temperature of about 82° C. to about 92° C.

In other embodiments of the invention, the process used to recover the alkaline values provides a barren liquor that is the aqueous solvent, without need of sodium carbonate or sodium hydroxide treatment, that eliminates or manages the clogging caused by dissolved sodium bicarbonate supersaturation and nahcolite and wegscheiderite precipitation.

A further embodiment of the invention is a method of solution mining trona that includes injecting an aqueous solvent into an underground cavity comprising trona to dissolve trona in the aqueous solution at a trona dissolution surface. The method further includes removing aqueous solution from the cavity, wherein the removed aqueous solution is at about a temperature ranging from 25° C. to 135° C. and producing an aqueous solvent by controlling the process of recovering alkaline values, treating the barren liquor from the process of recovering alkaline values, and/or treating injected aqueous solvent. In the method the aqueous solvent controls the reduction in sodium bicarbonate saturation as the solution approaches double saturation. In the method, the amount and ratio of the sodium carbonate and sodium bicarbonate content of the aqueous solvent can reduce the reduction in the sodium bicarbonate saturation percentage, as it approaches double saturation, to less than about 3%.

DETAILED DESCRIPTION

One embodiment of the invention teaches trona solution mining in the proximity of the WTN triple point to economically manage clogging of the trona dissolution surface caused by a dissolved SBC reduction as the solution approaches the double saturated condition. The WTN triple point is where solid phase wegscheiderite, nahcolite, and trona can coexist. Controlling the dissolved SBC reduction, as the solution approaches double saturation, provides the means to manage or eliminate clogging that is known to hinder current trona solution mining practices.

Trona's crystal structure is unique. While trona contains the building blocks to make soda ash and sodium bicarbonate, solid phase soda ash and sodium bicarbonate do not exist in trona. Trona does not leach—it dissolves. When it dissolves, the resulting solution contains sodium ions, carbonate ions, bicarbonate ions, and water. As long as the solution in in effective contact with trona, the dissolution process progresses until the solution is double saturated. In the case of trona aqueous dissolution in the nahcolite or wegscheiderite solid phase regions, the dissolved SBC becomes saturated before the dissolved SC becomes saturated. In this case, trona dissolution continues until both the dissolved SC and SBC are at saturation. This is the condition commonly referred to in the industry as being "double saturated". In reaching the double saturated condition, excess dissolved sodium bicarbonate supersaturates and can precipitate as nahcolite or wegscheiderite in a manner that can clog the trona dissolution surface. Sufficient clogging practically stops the trona dissolution and cavity formation process.

Figure 3:
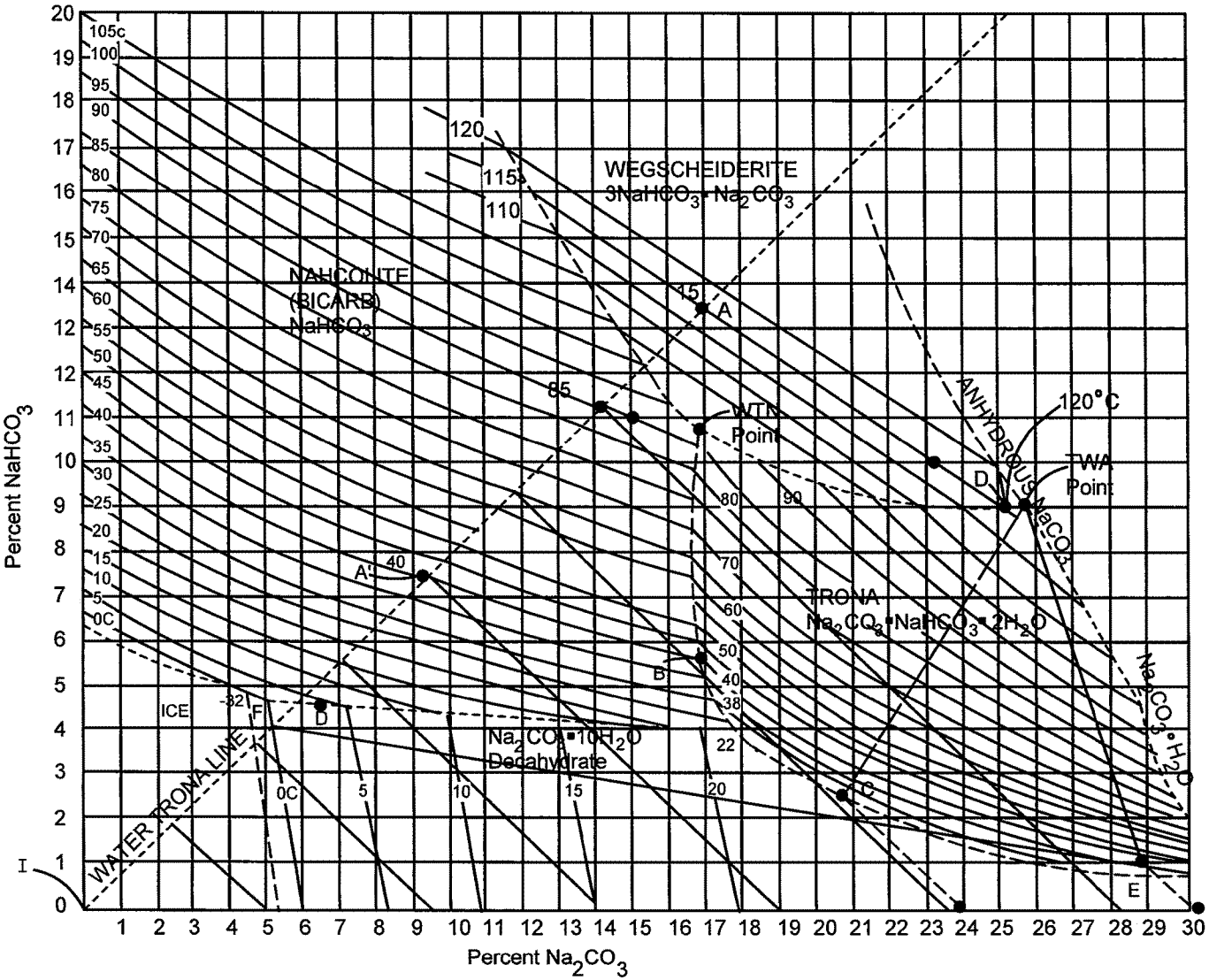
FIG. 3 is a solubility diagram for the $Na_2CO_3$—$NaHCO_3$ system.

A trona crystal dissolves instead of preferentially leaching various portions of the trona. At 40° C., water dissolving trona first becomes sodium bicarbonate saturated (FIG. 1, point A') at 7.5% SBC and then becomes doubled saturated at 5.6% dissolved SBC (FIG. 1, point C') at 5.6% SBC. In approaching double saturation, the SBC saturation reduction is 1.9% (7.5%-5.6%). At this point, trona dissolution stops as both the dissolved SC and SBC are at saturation with trona in the solid phase. The 1.9% dissolved SBC reduction is known to cause clogging that hinders trona solution mining. The hindrance occurs when the solution contacts only the precipitated nahcolite that clogs the trona surface. At this condition, due to clogging, the saturated solution is in contact with nahcolite, not trona, reducing the double saturated concentration to 7.5% SBC and 9.4% SC (FIG. 1, point A') instead of the more desirable 5.6% SBC and 17% SC (FIG. 1, point C') concentration in effective dissolution contact with trona. (Reference FIGS. 1 and 3)

It is known that that clogging can cause a significant loss of productivity (about 20%) when recovered solutions are in the range of 30° C. to 40° C. The effect of clogging at higher temperatures is not well known. Dissolution experiments were conducted at Hazen Research, Denver Colo., using an autoclave pressurized to simulate water injection solution mining conditions at the 87° C. WTN and 118° C. TWA triple points to examine the effects of clogging at higher temperatures. Surprisingly, the effect of the clogging was not noticeable at the 87° C. WTN as it is at conventional trona solution mining temperatures. The effect of clogging at 118° C. was problematic. In part, the favorable experimental result at 87° C., relative to 40° C. experience may be due to 55% reduction in clogging and a higher dissolution rate (see FIGS. 1 and 2). As previously noted, the 40° C. reduction in the dissolved SBC approaching double saturation is 1.8%. At 87° C., trona dissolution along the water-trona line becomes SBC saturated at 11.6%. The WTN dissolved SBC, at double saturation, is 10.8%. Therefore, the reduction in dissolved SBC approaching double saturation at the WTN point is 0.8%, a decrease of 55% from the 1.8% at 40° C. The SBC reduction approaching double saturation at the TWA point is 4.7%. That is about 6 times more clogging potential than at the WTN point. Apparently, the higher dissolution rate at 118° C. is not able to overcome the 6-fold increase in clogging relative to the WTN experimental results. Trona dissolution at 40° C. (1.8% dissolved SBC reduction approaching double saturation) and 118° C. (4.7% dissolved SBC reduction approaching double saturation reduction) is severely inhibited by clogging. Surprisingly, trona dissolution at 87° C. (0.8% SBC reduction) is not severely inhibited by clogging. Not severely inhibited, in this case, means achieving nearly full double saturation solution concentrations of dissolved SC and SBC at the isotherm line intercept with the trona solid phase boundary.

One aspect of this invention is trona aqueous solution mining at about the WTN triple point in the proximity of 87° C. This is the point that minimizes the reduction of dissolved SBC as the solution approaches double saturation in solvent comprised of water or the common solvent mixtures used in current trona solution mining processes. Temperatures above and below the WTN point increase the reduction in dissolved SBC, and clogging potential, as the solution approaches double saturation.

Figure 2:
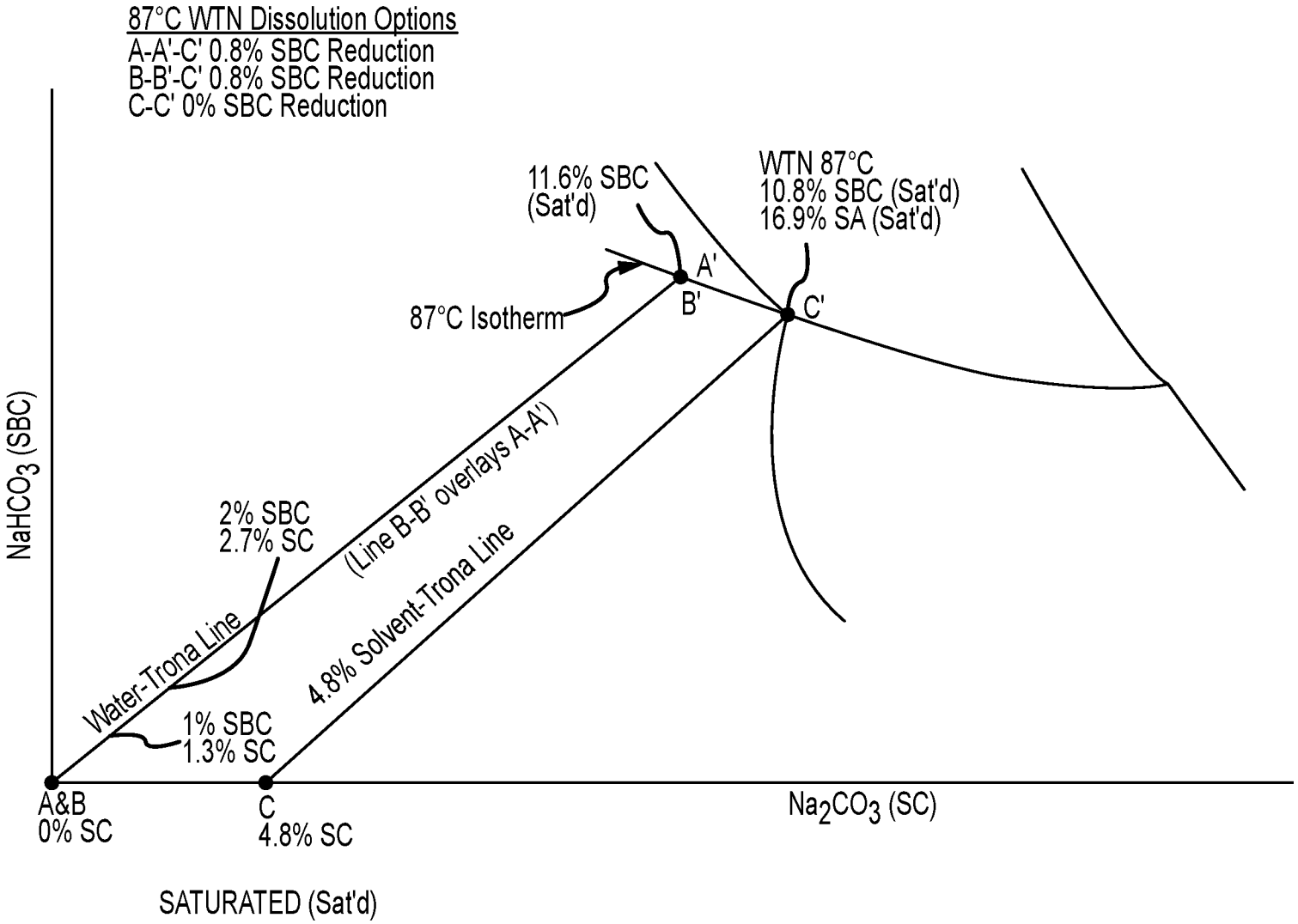
FIG. 2 is a simplified solubility diagram for the $Na_2CO_3$—$NaHCO_3$ system depicting a few examples of WTN triple point (87° C.) trona solution mining methods typical of the present invention.

This invention includes a method where the aqueous solvent for injection into an underground cavity has been treated with sodium hydroxide and/or SC to manage the effects of clogging. To eliminate clogging, the aqueous solvent can be treated with sodium hydroxide and/or SC in a manner that shifts the solvent-trona dissolution line to intercept or approach desired temperature isotherm at the contact with the solid phase trona region. To eliminate bicarbonate supersaturation at 40° C. temperature, trona dissolution must follow line C-C' (FIG. 1) that originates from the 0% SBC and 11.8%% SC point and extends to the intercept of the 40° C. isotherm with the trona solid phase region at point C'. This line can be approximated by the equation % SC=about ((% SBC*0.93)+11.8%). An aqueous solvent, with any ratio of SC and SBC that corresponds to this line, will eliminate clogging at dissolution temperature of 40° C. For example, a 1% SBC solvent requires about 12.7% SC to eliminate dissolved SBC supersaturation, a 3% SBC solvent requires about 14.7% SC (FIG. 1), and so on. Similarly, clogging can be eliminated at 87° C. by following a solvent-trona line C-C' (FIG. 2) originating at about 4.8% SC and 0% SBC and conforming to the equation % SC=about ((% SBC*1.12)+4.8%). An aqueous solvent, with any ratio of SC and SBC that corresponds to about FIG. 2 line C-C', will eliminate or substantially reduce clogging at a dissolution temperature of 87° C. The factors 0.93 and 1.12 are the slopes of lines C-C' (FIGS. 1 and 2).

Aqueous solvent-trona dissolution lines can be calculated by beginning at any % SC point along the 0% SBC axis of the phase diagram and stoichiometrically dissolving trona. Conversely, the aqueous solvent-trona lines can be calculated by starting at a point along the temperature isotherm and stoichiometrically precipitating trona.

The dissolution experiments revealed that highly productive trona solution mining can be accomplished by managing the clogging potential by operating near the WTN point. One aspect of water-trona solution mining at the WTN triple point is that the SBC reduction (0.8%) approaching double saturation is at minimum. Water-trona dissolution at the WTN temperature reduces the clogging potential relative to 40° C. by 55% (1.8% to 0.8%). Experiments show that, despite a 0.8% reduction in dissolved SBC, the double saturated solution approaches the high concentration of FIG. 2 point C'.

Any mixture of SC and SBC along the water-trona line A-A' (FIG. 2) can provide the same highly concentrated saturated solution (point C'). For example, 1% SBC and 1.3% SC, or 2% SBC and 2.7% SC, or any ratio conforming to the equation: % SC=(% SBC*1.25). Improved productivity favors the use of the lowest practical barren liquor and aqueous solvent SC and SBC concentrations.

Another aspect is using a solvent-trona line that does not originate at 0% SC and 0% SBC (i.e. not water) but a solvent-trona line that results in a desired SBC reduction approaching double saturation. In the case of 40° C., a 0.8% SBC reduction approaching double saturation means that dissolved SBC would first saturate at 6.4% at point B' and then reduce to 5.6% at point C' (FIG. 1). To limit the % SBC reduction to 0.8% follow the 40° C. isotherm to the intercept with 6.4% SBC (5.5%+0.8%). This is the point where SBC is saturated at 6.4% and SC is not saturated. From this point, stoichiometrically remove trona (FIG. 1, line B-B') to arrive at a point of being at 0% SBC and 6% SC. This could be called the 6% SC solvent-trona dissolution line or 6% SC solvent-trona line. Any SC and SBC ratio conforming to this line, % SC=about (% SBC*1.11)+6%), will result in about a 0.8% dissolved SBC reduction approaching doubled saturation at 40° C.

Kube teaches sodium hydroxide treatment of an aqueous solvent to convert SBC to SC within the dissolution cavity to eliminate clogging. The present invention teaches a more economical method. An aspect of this invention is the use of far less sodium hydroxide to accomplish similar results by (i) operating about the WTN triple point, (ii) managing (not eliminating) clogging, (iii) controlling the process of recovering alkaline valves and/or (iv) treating the barren liquor SC and SBC amount and ratio. In the present invention, sodium hydroxide is used to adjust the amount and ratio of the SBC and SC in the aqueous solvent in accordance with the formula $NaHCO_3+NaOH=Na_2CO_3+H_2O$. In this case, one unit of sodium hydroxide reacts with 2.1 units of SBC to yield 2.65 units of SC and 0.45 units of water. Enriching the solvent with the addition 2.65 units of SC is similar to about the addition of one unit of sodium hydroxide. The use of sodium hydroxide reacting in the cavity adds complexity and cost, however it provides a higher yield of alkaline products. In another aspect, managing the amount and ratio of the SC and SBC in the aqueous solvent results in recovered solution concentration. In another aspect, the use of less sodium hydroxide accomplishes similar results by managing instead of eliminating the dissolved SBC reduction approaching double saturation. In the 40° C. scenario, Kube teaches reducing the SBC reduction approaching double saturation by from about 1.8% to 0% (elimination). The present invention accomplishes similar results by reducing the SBC reduction at double saturation from 1.8% to 0.8% instead of 0%. This has the potential of a similar recovered solution concentration with 55% less sodium hydroxide consumption and is thus far less costly.

One aspect of the present invention is the use of an elevated temperature trona dissolution process to gain a highly concentrated solution that, relative to the composition of trona, is rich in the desirable soda ash and depleted in respect to sodium bicarbonate. The dissolution experiments revealed that the higher dissolution rate and reduced clogging at the WTN point yield a highly concentrated recovered solution when the dissolved SBC reduction approaching double saturation is 0.8%.

The optimum trona dissolution and recovery of alkaline values is that which approaches the temperature and composition of the WTN triple point. The WTN point is the point where trona dissolution clogging is at a minimum in a water-trona system. The phase diagram (FIG. 2) shows the WTN temperature at about 87° C.

During trona solution mining in accordance with the present invention, incongruent dissolution in the proximity of the WTN point favors low production cost but congruent dissolution favors higher resource recovery. Congruent and incongruent dissolution results from the amount and ratio of SBC and SC in the aqueous solvent. For example, treating the barren liquor can include the addition of sodium hydroxide and/or SC to manage the SC to SBC amount and ratio in the solvent to reduce or eliminate clogging. The desired aqueous solvent SC and SBC amount and ratio can be controlled by one or more of the following techniques: (1) control of the process of recovering alkaline values from removed aqueous solution, (2) addition of SC to the barren liquor that results from the process of recovering alkaline values, (3) conversion of the barren liquor SBC to SC to prepare the aqueous solvent for injection, and (4) addition of sodium hydroxide to an injected solvent that is depleted of SBC to convert SBC to SC during the process of trona dissolution.

As used herein, reference to the WTN triple point temperature refers to the temperature at which solid phase wegscheiderite, nahcolite, and trona can coexist in an aqueous solution. The WTN triple point temperature and concentrations are not well known and can be altered. In particular embodiments, the WTN temperature can be between about 50° C. and about 125° C., between about 60° C. and about 115° C., between about 65° C. and about 110° C., between about 70° C. and about 105° C., between about 75° C. and about 100° C., between about 80° C. and about 95° C., between about 85° C. and about 90° C. or about 87° C. Alternatively, the WTN temperature can be in a range having as a lower end point any whole number temperature between 50° C. and 86° C. and having as an upper end point any whole number temperature between 88° C. and 115° C., for example, a range of between 61° C. and 108° C. or between 71° C. and 101° C. Alternatively, the WTN triple point is about 87° C. In another aspect of the method of the invention, the temperature of the removed aqueous solution is above 50° C., above 70° C. or above 80° C.

Applied to the established trona solution mining practice, treating the aqueous solvent with SC to control precipitation is not economic due to the extreme loss of productivity and efficiency. As provided in the example section herein, the trona solution mining temperature is often conducted at about 40° C. or less (see Example 1) where a saturated solution should approach about 20.5% TA at 17% SC and 5.6% SBC (FIG. 1, point C'). This concentration is not achieved by current trona solution mines due, at least in part, to clogging. Congruent dissolution would more closely approach the 20.5% TA concentration. In the 40° C. case, a barren liquor could be treated to prepare a congruent solvent containing, for example, 0% SBC and 11.8% SC (11.8% TA). Such a congruent solvent would prevent or reduce precipitation and clogging and achieve high solution concentration and resource recovery but the high SC recycle rate is economically challenging as the yield is reduced to only 8.5% TA (20.3-11.8).

One aspect of the present invention regulates the aqueous solvent amount and ratio of SC and SBC to avoid or minimize the debilitating effects of clogging in the proximity of the WTN triple point. More particularly, in some embodiments of aqueous trona dissolution at the WTN triple point, a congruent solvent has an SC content between about 0% SC and about 11% SC, between about 2% and about 9% SC and about 3% and about 7% SC, or about 4.8% SC or alternatively, any range having a lower boundary of any tenth of a whole number between 0% SC and 4.7% SC and having an upper boundary of any tenth of a whole number between 4.9% SC and 11% SC. As shown in Example 2 (solution mining near the WTN triple point), a solvent with 0% SBC and 4.8% SC eliminated clogging and yielded 18.9% TA. As used herein, reference to regulating the SC and SBC content of the aqueous solvent refers to controlling or modifying the SC and SBC content of the barren liquor or an existing aqueous solution to form a solvent that is within levels specified herein and can include the addition or removal of sodium carbonate, SBC removal or conversion to SC by sodium hydroxide reaction that occurs either during the barren liquor treatment to prepare the solvent or subsequently in the cavity.

In one aspect, regulating SC and SBC content is accomplished, in whole or in part, by the process of recovering alkaline values from the removed aqueous solution. The process of solution mining and alkaline value recovery are integrated in that the SC and SBC, not recovered from the aqueous solution, are recycled to the mine. The process of recovering alkaline values can provide a barren liquor with a ratio of SC and SBC that manages clogging by shifting the solvent-trona dissolution lines (FIGS. 1 and 2) from the water-trona lines (A-A') toward solvent-trona lines C-C' that intercept the solid phase trona region at the desired recovery solution temperature. The solvent-trona dissolution line (C-C') that intercepts the trona region at the desired temperature eliminates the potential for clogging by eliminating the reduction in SBC solubility as the solution approaches double saturation. However, it is not necessary to eliminate the reduction in SBC solubility and clogging. Clogging can be managed by controlling the SBC solubility reduction to about 0%; or less than about 0.4%, or 0.8%, or 1.2%, or 1.6% or 2%, or 3%. FIGS. 1 and 2 lines (B-B') control the SBC solubility reduction to about 0.8%.

In a further aspect, clogging is controlled by reducing the SBC in the barren liquor by treating with sodium hydroxide or other known processes. The most efficient process results from the lowest practical barren liquor SC and SBC content solvent provided by the process of recovering alkaline values. In some embodiments of the invention, the barren liquor and aqueous solvent are controlled to have low or no amounts of dissolved sodium bicarbonate and sodium hydroxide. Is such case and for example, the amount of sodium carbonate in the aqueous solvent to manage clogging can be about 0%, 1%, 2%, 3%, 4%, 5%, 6%, 7% or any percentage between the range of about 0% to about 7%. In one aspect, the amount of sodium carbonate in the aqueous solvent is less than 7%, less than 6%, less than 5%, less than 4%, less than 3%, less than 2%, less than 1%. In yet another aspect, the amount of sodium carbonate in the aqueous solvent is in a range of 3% to 6%. In one aspect, the reduction in SBC saturation percentage as double saturation is approached, is less than about 3%, less than 2%, less than 1.9%, less than 1.8%, less than 1.7%, less than 1.6%, less than 1.5%, less than 1.4%, less than 1.3%, less than 1.2%, less than 1.1%, less than 1.0%, less than 0.9%, less than 0.8%, less than 0.7%, less than 0.6%, less than 0.5%, less than 0.4%, less than 0.3%, less than 0.2%, less than 0.1% or about 0.

In other embodiments of the invention, the aqueous solvent is treated with sodium hydroxide to have low or no amount of sodium bicarbonate. For example, the amount of sodium hydroxide in the aqueous solvent can be less than about 5%, less than about 4%, less than about 3%, less than about 2%, less than about 1%, or about 0%.

The invention can also include control of the amount and ratio of sodium bicarbonate to sodium carbonate in a congruent solvent, i.e., a solvent that eliminates clogging. In one aspect, the congruent solvent sodium bicarbonate and sodium bicarbonate amount and ratio conforms to the equation % SC=(% SBC*X)+Y. In accordance with the phase diagram FIG. 2 line C-C', X is about 1.12 and Y is about 4.8. The factor X can range from about 0.8 to about 1.3 or from about 1.0 to about 1.2. The factor Y can range about 2% to about 7% or from about 3.8% to about 5.8% or any percentage between the range of about 2% to about 7% or about 3.8% to about 5.8%.

In another aspect of the invention, the aqueous solvent is controlled to have low or no amount of sodium bicarbonate and the amount of sodium hydroxide and SC treatment of the injected aqueous solvent manages clogging by controlling the reduction in SBC saturation percentage as the solution approaches double saturation. For example, the aqueous solvent can be controlled to have sodium bicarbonate in an amount less than about 6%, less than about 5%, less than about 4%, less than about 3%, less than about 2%, or less than about 1%. In one aspect, the required amount of sodium hydroxide in the aqueous solution to reduce the clogging conforms about to the equation: sodium hydroxide=about (SBC to be converted to SC)*0.48. To avoid debilitating clogging, the reduction in SBC saturation approaching double saturation is reduced to about 0% to 2%, or 0% to 1%, or 0.3% to 1% to avoid debilitating clogging. Any sodium bicarbonate present in the barren liquor stoichiometrically increases the required amount of sodium hydroxide and/or SC. Any sodium carbonate present in the injected solvent stoichiometrically reduces the required amount of sodium hydroxide. In the case of a solvent devoid of SBC, clogging can be managed by controlling either sodium hydroxide or sodium carbonate or in combination. In one aspect, the SBC reduction approaching double saturation, following sodium hydroxide SBC conversion to SC, is in a range of less than about 1.6%, less than about 1.5%, less than about 1.4%, less than about 1.3%, less than about 1.2%, less than about 1.1%, less than about 1.0%, less than about 0.9%, less than about 0.8%, less than about 0.7%, less than about 0.6%, less than about 0.5%, less than about 0.4%, less than about 0.3%, or less than about 0.2%.

In various embodiments of the invention, the yield is greater than about 10% TA, greater than about 12% TA, greater than about 14% TA, greater than about 16% TA, greater than about 18% TA, or greater than about 19% TA, or greater than 20% TA, greater than about 21% TA, greater than about 22% TA, greater than about 23% TA, or greater than about 23.7% TA. In some embodiments, the present invention can increase the yield 118% by solution mining at the 87° C. WTN triple point compared to the 40° C. example (Example 1).

The present invention provides unique and previously unrecognized advantages over known trona solution mining techniques. Day (U.S. Pat. No. 7,611,208) teaches a 118° C. (TWA triple point) temperature incongruent trona solution mining method recovering nearly 32% TA solution. This is greater than the potential for 20% to 24% TA when incongruent solution mining in about 40° C. or 87° C. (WTN triple point). However, as mentioned above, incongruent dissolution at any temperature can precipitate sodium bicarbonate and/or wegscheiderite that hinder the solution mining process and economics. While this hindrance can be tolerated as demonstrated by the ongoing commercial incongruent trona solution mining method practiced in Turkey and as taught by Day, practice of the present invention improves trona solution mining productivity and economy by controlling clogging caused by the reduction in the dissolved sodium bicarbonate as the solution approaches the double saturated condition.

The dissolution experiments, conducted at the Hazen Labs in Denver Colo., dissolved ground and screened trona ore in water at about the WTN triple point (87° C.) and TWA triple point (118° C.) in an agitated autoclave under pressure to (1) avoid sodium bicarbonate decomposition and (2) simulate the condition in a trona solution mining cavity. Unexpectedly, it was found that trona dissolution at the WTN triple point (about 87° C.) did not experience noticeable debilitating consequences of clogging achieving 22.2% TA in ½ hour and 23.5% TA in 1 hour. That is 93% saturated in ½ hour and 98% saturated in 1 hour (relative to the saturation indicated by the FIG. 14 phase diagram). These experiments reveal that highly concentrated solution can be expected by solution mining trona at about the WTN triple point. This favorable finding is in-part due to the proximity of the WTN triple point to the water-trona dissolution line. A key discovery is that the close proximity of the WTN point to the water-trona line minimizes the potential amount of sodium bicarbonate and wegscheiderite precipitation that can clog or encapsulate the trona dissolution surface. An examination of the FIG. 3 phase diagram reveals that the WTN triple point is the optimum point at which the water-trona dissolution clogging potential is at minimum. The amount and potential debilitating effects of clogging increase at temperatures both above and below the WTN triple point. The higher temperature of the WTN point, relative to common trona solution mining practice, also contributes to the surprisingly favorable result by increasing the dissolution rate. Impurities impacting the phase diagram and dissolved SBC supersaturation may also play a role. Natural occurring trona contains impurities that can alter (1) the temperature and concentration of the WTN point and (2) the degree and effect the clogging. In the Green River Basin, the dominant trona impurities are halite, nahcolite, and wegscheiderite. Based on the current disclosure, experts in the field will be able to adjust the disclosed WTN trona solution mining method to accommodate these and other impurities.

Recouped heat from the process of recovering alkaline values (the surface plant) can provide much of the heat required for WTN trona solution mining at low cost.

During experimentation, the improved dissolution results at WTN triple point held as the experimental temperature was increased to advance along the phase diagram line where solid phase wegscheiderite and trona can co-exist. This line extends from the proximity of the WTN triple point (about 87° C.) to the proximity of the TWA triple point (about 118° C.). At about 95° C., the dissolution test results began to diverge from the phase diagram. At the TWA point (about 118° C.), the TA assay at 2 hours was only 27.7% or 88% saturated compared to the expected 31.5 TA, whereas 98% saturation was achieved in one hour at the WTN (87° C.) point. The divergent results at temperatures approaching 118° C. demonstrate the need to avoid excessive clogging.

Unexpectedly, the experimental results demonstrated that it is only necessary to reduce to about 0.8%, not eliminate, the reduction in dissolved SBC supersaturation approaching double saturation.

EXAMPLES

The following examples are provided for purposes of illustration and are not intended to limit the scope of the invention.

The present invention teaches productive and economic methods to minimize or eliminate, rather than mitigate, the hindrances of incongruent dissolution by solution mining trona in the proximity of the WTN triple point. Below are examples of congruent trona solution mining aqueous solvent conditions at three operating temperatures previously mentioned.

Comparative Example 1: 40° C. Trona Saturation is 16.8% SC, 5.6% SBC, 20.3% TA In this comparative example using a 40° C. solution (i.e., not at the WTN or the TWA triple point), precipitation of the sodium bicarbonate and/or wegscheiderite is eliminated by injecting one of the following exemplary aqueous solvents comprising:

a) 11.8% SC, 0% SBC, 11.8% TA: Yield 8.5% TA (base case);
b) 12.7% SC, 1% SBC, 13.3% TA: Yield 7.0% TA (base case);
c) 13.6% SC, 2% SBC, 14.9% TA: Yield 5.4% TA; or
d) 15.4% SC, 4% SBC, 17.9% TA: Yield 2.4% TA;
e) 6% SBC—not applicable The highest TA yield achieved in this comparative example is 8.5%.

Example 2: WTN Triple Point Saturation is at 87° C., 16.9% SC, 10.8% SBC, 23.7% TA In this example, precipitation of the sodium bicarbonate and/or wegscheiderite is eliminated by injecting one of the following exemplary aqueous solvents comprising:

a) 4.8% SC, 0% SBC, 4.8% TA: Yield 18.9% TA;
b) 6.0% SC, 1% SBC, 6.6% TA: Yield 17.1% TA;
c) 7.0% SC, 2% SBC, 8.3% TA: Yield 15.4% TA;
d) 9.3% SC, 4% SBC, 11.8% TA: Yield 11.9% TA; or
e) 11.6% SC, 6% SBC, 15.4% TA; Yield 8.3% TA.

The highest TA yield achieved in this example is 18.9%, as compared to 8.5% using a 40° C. as shown in Example 1.

Example 3: TWA Triple-Point Saturation is at 118° C., 25.8% SC, 9% SBC, 31.5% TA In this example, precipitation of the sodium bicarbonate and/or wegscheiderite is eliminated by injecting one of the following exemplary aqueous solvents comprising:

a) 18.8% SC, 0% SBC, 18.8% TA: Yield 12.7% TA;
b) 19.6% SC, 1% SBC, 20.2% TA: Yield 11.3% TA;
c) 20.4% SC, 2% SBC, 21.7% TA: Yield 9.8% TA;
d) 21.9% SC, 4% SBC, 24.4% TA: Yield 7.1% TA; or
e) 23.4% SC, 6% SBC, 27.2% TA: Yield 4.3% TA;

The highest TA yield achieved in these examples of congruent dissolution is 18.9% at 87° C., as compared to 8.5% using a 40° C. and 12.7% at 118° C.

All of the documents cited herein are incorporated herein by reference.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following exemplary claims.

What is claimed is:

1. A method of solution mining trona, comprising:

a. injecting an aqueous solvent into an underground cavity comprising trona to produce an aqueous solution that dissolves the trona at a trona dissolution surface, wherein the aqueous solution controls and/or eliminates any reduction of sodium bicarbonate saturation and/or precipitation of nahcolite and/or precipitation of wegscheiderite at the trona dissolution surface during trona dissolution in the cavity;

b. removing the aqueous solution from the cavity, wherein the removed aqueous solution is at about a temperature of 25° C. to 135° C.; and c. recovering alkaline values from the removed aqueous solution.

2. The method of claim 1, wherein the amount of sodium hydroxide in the aqueous solvent is about 0%.

3. The method of claim 1, further comprising treating the aqueous solvent in the cavity.

4. The method of claim 1, wherein the reduction in sodium bicarbonate saturation is less than 3%.

5. The method of claim 1, wherein the reduction in sodium bicarbonate saturation is less than 2%.

6. The method of claim 1, wherein the reduction in sodium bicarbonate saturation is less than 1.5%.

7. The method of claim 1, wherein the reduction in sodium bicarbonate saturation is less than 0.8%.

8. The method of claim 1, wherein the aqueous solution is a congruent solvent.

9. The method of claim 1, wherein the removed aqueous solution is at a temperature above 50° C.

10. The method of claim 1, wherein the removed aqueous solution is at a temperature above 70° C.

11. The method of claim 1, wherein the removed aqueous solution is at a temperature above 80° C.

12. The method of claim 1, wherein the removed aqueous solution is at about the WTN triple point.

13. The method of claim 1, wherein the step of recovering alkaline values is selected from the group consisting of:

i. crystallization of sodium carbonate;

ii. crystallization of sodium bicarbonate;

iii. crystallization of sodium sesquicarbonate; and iv. combinations of i.-iii.

14. A method of solution mining trona, comprising:

a. injecting an aqueous solvent into an underground cavity comprising trona to produce an aqueous solution that dissolves the trona at a trona dissolution surface, wherein the aqueous solution is a congruent solvent;

b. removing the aqueous solution from the cavity, wherein the removed aqueous solution is at about a temperature of 25° C. to 135° C.; and c. recovering alkaline values from the removed aqueous solution.

15. The method of claim 14, wherein the amount of sodium hydroxide in the aqueous solvent is about 0%.

16. The method of claim 14, further comprising treating the aqueous solvent in the cavity.

17. The method of claim 14, wherein the removed aqueous solution is at a temperature above 50° C.

18. The method of claim 14, wherein the removed aqueous solution is at a temperature above 70° C.

19. The method of claim 14, wherein the removed aqueous solution is at a temperature above 80° C.

20. The method of claim 14, wherein the removed aqueous solution is at about the WTN triple point.

21. The method of claim 14, wherein the step of recovering alkaline values is selected from the group consisting of:

i. crystallization of sodium carbonate;

ii. crystallization of sodium bicarbonate;

iii. crystallization of sodium sesquicarbonate; and iv. combinations of i.-iii.

22. A method of solution mining trona, comprising:

a. injecting an aqueous solvent into an underground cavity comprising trona to produce an aqueous solution that dissolves the trona at a trona dissolution surface;

b. removing the aqueous solution from the cavity at a temperature at about the WTN triple point; and c. recovering alkaline values from the removed aqueous solution.

23. The method of claim 22, wherein the injected solvent comprises a liquid selected from the group consisting of water, barren liquor, a stream produced by recovery of alkaline values and combinations thereof.

24. The method of claim 22, wherein the aqueous solution controls and/or eliminates any reduction in sodium bicarbonate saturation and/or precipitation of sodium bicarbonate and/or wegscheiderite as the solution approaches double saturation.

25. The method of claim 22, wherein the injected solvent is treated water, treated barren liquor, and/or a treated stream produced by recovery of alkaline values.

26. The method of claim 22, wherein the aqueous solvent temperature is about the WTN triple point.

27. The method of claim 22, wherein the removed aqueous solution is at a temperature above 50° C.

28. The method of claim 22, wherein the removed aqueous solution is at a temperature above 70° C.

29. The method of claim 22, wherein the removed aqueous solution is at a temperature above 80° C.

30. The method of claim 22, wherein the step of recovering alkaline values is selected from the group consisting of:

i. crystallization of sodium carbonate;

ii. crystallization of sodium bicarbonate;

iii. crystallization of sodium sesquicarbonate; and iv. combinations of i.-iii.

* * * * *